US012460646B2

(12) United States Patent
Bäcke

(10) Patent No.: US 12,460,646 B2
(45) Date of Patent: Nov. 4, 2025

(54) METHOD FOR PERFORMING PRIMING OF A SUBMERSIBLE PUMP

(71) Applicant: Xylem Europe GmbH, Schaffhausen (CH)

(72) Inventor: Jan Bäcke, Svartsjö (SE)

(73) Assignee: Xylem Europe GmbH, Schaffhausen (CH)

( * ) Notice: Subject to any disclaimer, the term of this patent is extended or adjusted under 35 U.S.C. 154(b) by 0 days.

(21) Appl. No.: 18/692,420

(22) PCT Filed: Sep. 26, 2022

(86) PCT No.: PCT/EP2022/076611

§ 371 (c)(1),
(2) Date: Mar. 15, 2024

(87) PCT Pub. No.: WO2023/052276

PCT Pub. Date: Apr. 6, 2023

(65) Prior Publication Data

US 2024/0376896 A1 Nov. 14, 2024

(30) Foreign Application Priority Data

Sep. 29, 2021 (EP) ..... 211996673

(51) Int. Cl.
*F04D 9/00* (2006.01)
*F04D 13/08* (2006.01)
*F04D 15/02* (2006.01)

(52) U.S. Cl.
CPC ..... *F04D 9/002* (2013.01); *F04D 15/0209* (2013.01); *F04D 13/086* (2013.01)

(58) Field of Classification Search
CPC ..... F04D 9/001–003; F04D 15/0066; F04D 15/0209; F04D 15/0218; F04D 15/0227;
(Continued)

(56) References Cited

U.S. PATENT DOCUMENTS 9,735,713 B2 * 8/2017 Ek ..... H02P 1/04
10,267,317 B2 4/2019 Lopes et al.
(Continued)

FOREIGN PATENT DOCUMENTS

EP 3246572 A1 11/2017
WO WO-03078839 A2 * 9/2003 ..... F04D 15/0209
WO 2019201803 A1 10/2019

OTHER PUBLICATIONS

Written Opinion of the International Searching Authority for International Application No. PCT/EP2022/076611, mailed Jan. 23, 2023, 4 pages.

*Primary Examiner* — Courtney D Heinle
*Assistant Examiner* — Jesse M Prager
(74) *Attorney, Agent, or Firm* — Buchanan Ingersoll & Rooney PC

(57) ABSTRACT

A method for priming of a pump in response to a priming condition includes confirming that the liquid level in the reservoir is located at the same level or above the upper portion of the impeller, driving the impeller in a reverse direction of rotation for a time duration between 2 seconds and 5 seconds, stopping the impeller from rotating in the reverse direction of rotation, driving the impeller in a forward direction of rotation, detecting, during the forward operation of the impeller, whether too much gas is present in the volute, and in response to detection of too much gas in the volute, stopping the impeller from rotating in the forward direction of rotation and driving the impeller in the reverse direction of rotation, and in response to non-detection of too much gas in the volute, exiting the priming of the pump.

9 Claims, 2 Drawing Sheets

(58) Field of Classification Search
CPC . F04D 15/0236; F04D 13/086; F04D 29/2283
See application file for complete search history.

(56) References Cited

U.S. PATENT DOCUMENTS

2010/0034665 A1* 2/2010 Zhong ..... F04D 15/0066
417/42
2023/0075841 A1* 3/2023 Tofte ..... F04D 15/0218

* cited by examiner

METHOD FOR PERFORMING PRIMING OF A SUBMERSIBLE PUMP

CROSS-REFERENCE TO RELATED APPLICATIONS

This is the U.S. National Phase of International Application No. PCT/EP2022/076611, filed Sep. 26, 2022, which claims priority to European Application No. 21199667.3, filed Sep. 29, 2021. The disclosure of each of these applications is incorporated herein by reference in its entirety for all purposes.

TECHNICAL FIELD OF THE INVENTION

The present invention relates generally to the field of methods for monitoring and controlling the operation of a submersible machine suitable for transporting liquid, such as a submersible sewage/wastewater pump or a submersible drainage pump. The present invention relates more specifically to the field of methods for priming a submersible pump in connection with the start of the pump in response to a priming condition. The reservoir is configured for temporary storing the liquid. The concept priming shall in this context be understood as removing gas from and/or adding liquid to the volute of the pump.

Thus, the present invention relates specifically to the field of monitoring and controlling the operation of a submergible pump, the pump being located in a reservoir containing a liquid, wherein the pump comprises an inlet, an outlet, a volute located between said inlet and said outlet, and an impeller located in said volute.

BACKGROUND OF THE INVENTION

For some applications, such as a pump station comprising a submersible pump, the pump is usually stopped by a control unit based on a stop-signal from a level sensor before the liquid surface falls below the inlet of the pump. During operation of a submersible pump there is no problem as long as the pump is able to pump/transport liquid, i.e. the inlet of the pump is located below the liquid surface and only liquid enters the pump volute.

However, when the liquid surface falls below the inlet of the pump, the pump will start to suck partly liquid and partly gas/air during operation, and the impeller will operate partly in liquid and partly in gas/air. This phenomenon is called snoring, due to the snoring sound generated by the pump during such conditions.

Snoring is in some application used as a safety measure and the pump will be stopped when it is identified that the pump is snoring, which for instance can be the case if the level sensor malfunctions. In other applications/situations the pump is intended to snore in order to remove the grease/waste floating on the liquid surface, or at least break the cake of grease/waste accumulated/generated at the liquid surface.

When the pump is snoring the operation of the pump is no longer productive/effective at the same time as the pump continues to consume energy, i.e. consumes a lot of energy without generating any liquid output. Thereto, the electric motor and other components of the pump might become damaged due to overheating/wear if the pump is left to snore a long period of time. Thus, in response to snoring the pump is stopped.

When the pump is stopped due to snoring almost always gas/air will remain present in the volute of the pump, i.e. the impeller is partly or wholly surrounded by gas/air. When the liquid level in the reservoir starts to raise above the inlet of the pump, the gas in the volute of the pump will be trapped.

The same problem/situation will also occur following a service/cleaning of the pump, i.e. when the pump is lowered into the reservoir and into the liquid. More precisely, the entire amount of gas/air in the volute will not be replaced by liquid and considerable amounts of gas/air will become trapped in the volute of the pump.

No matter how the gas/air is trapped in the volute, and also in situations the pump is well submerged under the liquid surface, the gas stays in the pump volute and entail a problem to start/restart the pump. Thus, the impeller is prevented from "grabbing" the liquid and push the gas out from the pump volute and into the outlet piping. In fact, the volute of the pump can be filled up to half of its volume with liquid and still the impeller cannot "grab" the liquid. Thus, a priming condition has arisen.

One known way to remove unwanted gas from the volute is disclosed in U.S. Pat. No. 10,267,317, wherein the pump has a small slit in the most upper part of the volute and when the pump is stopped, any air that is present in the volute will seep out through the slit. However, such slit has to be extremely small in order not to have negative effect on the pump performance of the pump and a small slit will become clogged by solid matter present in the pumped liquid.

OBJECT OF THE INVENTION

The present invention aims at providing an improved method for monitoring and controlling the operation of a submergible pump upon start of the pump. A primary object of the present invention is to provide an improved priming of a submersible pump upon start/restart of the pump in response to a priming condition. Another object of the present invention is to provide an improved priming of a submersible pump upon start/restart of the pump by devotedly removing the gas from the volute.

SUMMARY OF THE INVENTION

According to the invention at least the primary object is attained by means of the initially defined method having the features defined in the independent claim. Preferred embodiments of the present invention are further defined in the dependent claims.

According to the present invention, there is provided a method of the initially defined type, wherein the priming comprises the steps of:

- confirming that the liquid level in the reservoir is located at the same level or above the upper portion of the impeller,
- driving the impeller in a reverse direction of rotation in order to generate a flow of gas/liquid mixture from the volute out through the inlet of the pump, wherein the duration of the reverse operation of the impeller is equal to or more than 2 seconds and equal to or less than 5 seconds,
- stopping the impeller from rotating in the reverse direction of rotation,
- driving the impeller in a forward direction of rotation in order to generate a flow of liquid from the volute out through the outlet of the pump,
- detecting, during the forward operation of the impeller, whether too much gas is present in the volute preventing the impeller from generating the expected flow of liquid from the volute out through the outlet of the pump, and in response to detection of too much gas in the volute, stopping the impeller from rotating in the forward direction of rotation and returning to the step of driving the impeller in the reverse direction of rotation, and in response to non-detection of too much gas in the volute, exiting the priming of the pump.

According to the present invention, there is also provided a computer-readable storage medium having computer-readable program code portions embedded therein, wherein the computer-readable program code portions when executed by a computer cause the computer to carry out the steps of the inventive method in order to perform a priming of the pump.

Thus, the present invention is based on the understanding of the inventor that the reason for not being able to remove trapped air/gas is that the centrifugal force of the impeller when rotating pushes the existing liquid in the volute out of the impeller to the radially outer areas of the pump volute and the air/gas is moved inwards to the impeller and thereby the impeller just rotates in air/gas also in situations having rather much liquid present in the volute. This will occur already at the start of rotation of the impeller, and already at low rpm. Thus, there is no liquid contact between the liquid at the inlet of the pump, at the leading edge of the impeller, and the liquid in the pump volute, at the trailing edge of the impeller, and thereby no liquid is sucked into the impeller/volute. Thus, in order to "grab" the liquid the inventor has realized that it is crucial that the liquid that is forced outwards by the impeller has to be in liquid contact with the liquid at the inlet of the pump.

Thus, the gas has to be removed, and a significant amount of gas is removed from the volute at the beginning of each reverse operation of the impeller together with the liquid, and after the reverse operation is stopped the removed/ejected amount of gas and liquid is replaced by only liquid. A longer duration of each reverse operation will not remove any significant amount of gas from the volute, will risk to wear/overheat components of the pump due to lack of adequate cooling and consumes power without transporting liquid.

According to various embodiments of the present invention, the step of detecting whether too much gas is present in the volute during the forward operation of the impeller, comprises the steps of:

monitoring the correlation between the consumed power of the pump and the operational speed of the pump, and in response to a too low level of consumed power in relation to the operational speed of the impeller, it is detected that too much gas is present in the volute.

During normal operation of a pump the correlation between consumed power and operational speed of the pump is known for the specific application, but when the impeller rotates in a gas/liquid mixture the consumed power will decrease and/or the operational speed will increase changing the correlation and the priming condition is determined as still present.

According to various embodiments of the present invention, the step of detecting whether too much gas is present in the volute during the forward operation of the impeller, comprises the steps of:

monitoring whether the liquid level in the reservoir is raising, and in response to raising liquid level in the reservoir at the same time as the consumed power of the pump is below a predetermined threshold, it is detected that too much gas is present in the volute.

During normal operation of a pump the consumed power is above a known threshold, but when the consumed power is below a predetermined threshold at the same time as the liquid level in the reservoir is raising the priming condition is determined as still present According to various embodiments of the present invention, the duration of the forward operation of the impeller during the priming is equal to or more than 5 seconds and equal to or less than 30 seconds.

In order not to provide false conclusions regarding the priming condition, the forward operation has to be long enough such that initial fluctuations of the consumed power upon start of a pump does not mislead. A too long duration of the forward operation, when the priming condition is still present will risk to wear/overheat components of the pump due to lack of adequate cooling and consumes power without transporting liquid.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF THE PREFERRED EMBODIMENTS OF THE INVENTION

The present invention relates to a method for monitoring and controlling the operation of a submersible machine upon start, wherein the machine is suitable for transporting liquid such as sewage/wastewater, liquid comprising solid matter, slurry, clean water, etc. The machine is constituted by a submersible sewage/wastewater pump or a submersible drainage/dewatering pump 1. The present invention relates specifically to a method for priming a submersible pump in response to a priming condition, i.e. an operational condition wherein the impeller operates/rotates in air but the pump 1 is at least partly submerged.

Figure 1:
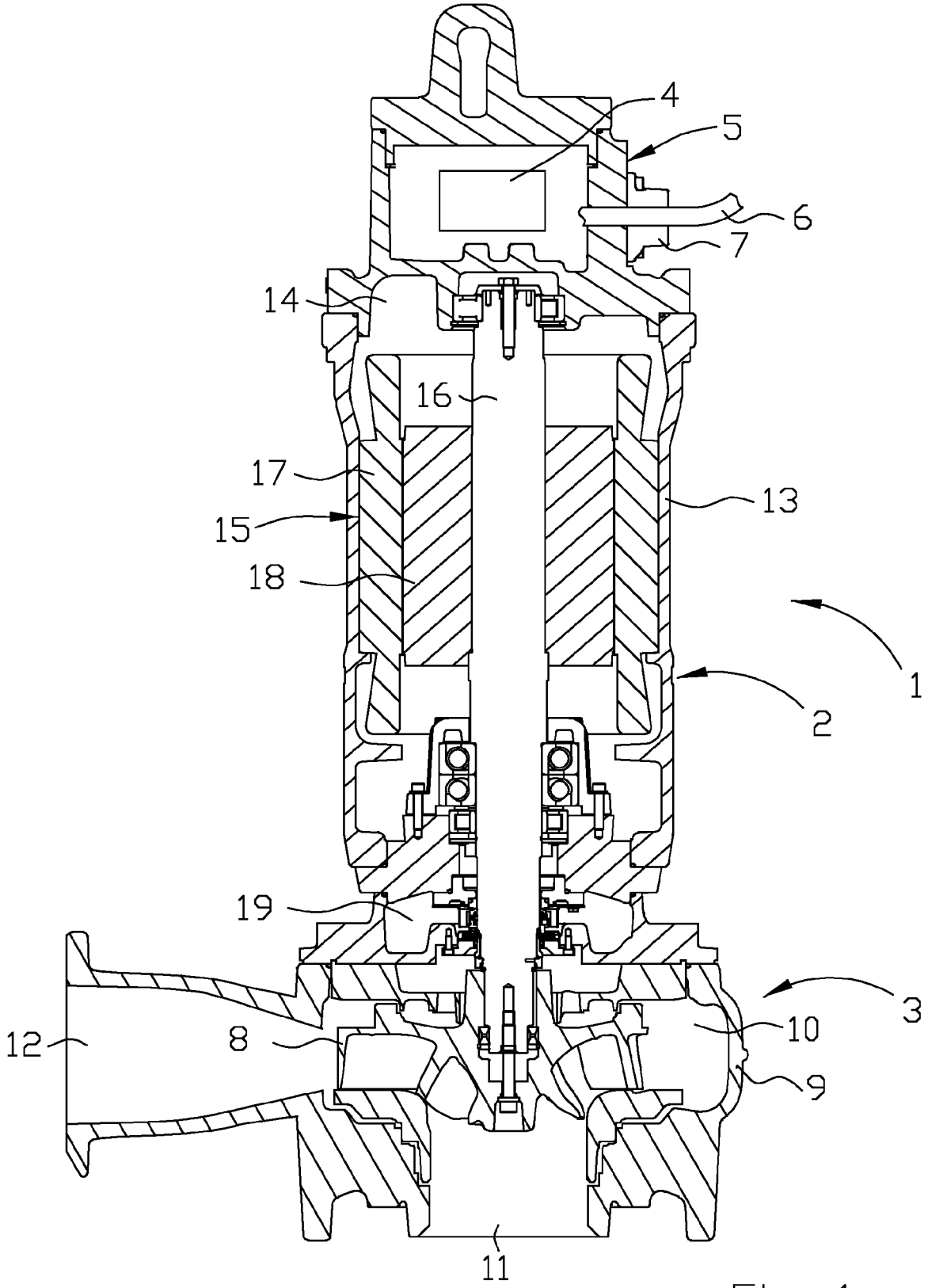
FIG. 1 is a schematic perspective view of an inventive submersible pump.

Reference is initially made to FIG. 1. The pump 1 comprises two major parts, a drive unit, generally designated 2, and a hydraulic unit, generally designated 3. Thereto the pump 1 is associated with a control unit 4. The control unit 4 monitors and controls the operation of the pump 1. In the disclosed embodiment the control unit 4 is integrated into and constitutes a part of the pump 1, i.e. the control unit 4 is located in a top unit 5 of the drive unit 2 of the pump 1. According to alternative embodiments the control unit 4 is constituted by a separate/external member and is operatively connected to the pump 1, or the control unit 4 is a combination of internal and external elements. An electric cable 6 extending from a power supply, for instance the power mains, provides power to the pump 1, the pump 1 comprising a liquid tight lead-through 7 receiving the electric cable 6. The electric cable 6 may also comprise signal wires for data communication between the pump and any external control unit. The control unit 4 comprises a Variable Frequency Drive (VFD). The control unit 4 is configured to perform the inventive method.

The submersible pump 1 is configured to be located entirely submerged, however it shall be pointed out that a submersible pump 1 can be partly located above the liquid surface during operation. According to the disclosed embodiment, the pump 1 is cooled by the liquid/media surrounding the drive unit 2, but the pump 1 may also or alternatively be cooled by a cooling arrangement comprising a cooling jacket surrounding at least parts of the motor compartment 14 or drive unit 2.

The hydraulic unit 3 comprises an impeller 8 configured for transporting/pumping the liquid. The hydraulic unit 3 comprises a pump housing 9 defining a volute 10, also known as pump chamber. Thereto, the hydraulic unit 3 comprises an inlet opening 11 and an outlet opening 12, wherein the volute 10 is located between said inlet 11 and outlet 12. The impeller 8 is located in the volute 10 and is configured to move liquid from the inlet opening 11 to the outlet opening 12 via the volute 10, when the submersible pump 1 is in operation. According to the disclosed embodiment the impeller 8 is a so called open impeller, but the present invention is also applicable to pumps 1 having a so called closed/channel impeller. An open impeller 8 comprises an upper shroud, a hub and one or more vanes extending from the shroud and hub. A closed impeller thereto comprises a lower shroud, wherein the vanes extend between the upper and lower shrouds.

The drive unit 2 comprises a drive unit housing 13 defining a motor compartment 14, an electric motor 15 being arranged in the motor compartment 14 and a drive shaft 16 connected to and driven in rotation by the electric motor 15. The electric motor 15 comprises a stator 17 and a rotor 18, wherein the drive shaft 16 is connected to the rotor 18 of the electric motor 15 in a conventional way. The drive shaft 16 extends from the electric motor 15 of the drive unit 2 to the hydraulic unit 3, wherein the impeller 8 is connected to and driven in rotation by the drive shaft 16 during operation of the submersible pump 1. Thus, the pump 1 is configured to be operated at a variable operational speed [rpm], by means of the control unit 4 that is configured to control the operational speed of the pump 1. The operational speed of the pump 1 is more precisely the rpm of the electrical motor 15 and of the impeller 8 and correspond/relate to a VFD output frequency.

The top unit 5, or electronics/connection chamber, is separated from the motor compartment 14 in a liquid tight manner. The volute 10 is separated from the liquid tight motor compartment 14 by means of a liquid seal chamber 19, preventing the pumped liquid to reach the motor compartment 14 along the drive shaft 16. The different housing parts of the pump 1 and the impeller 8 are preferably made of metal, such as aluminum and/or iron/steel.

Figure 2:
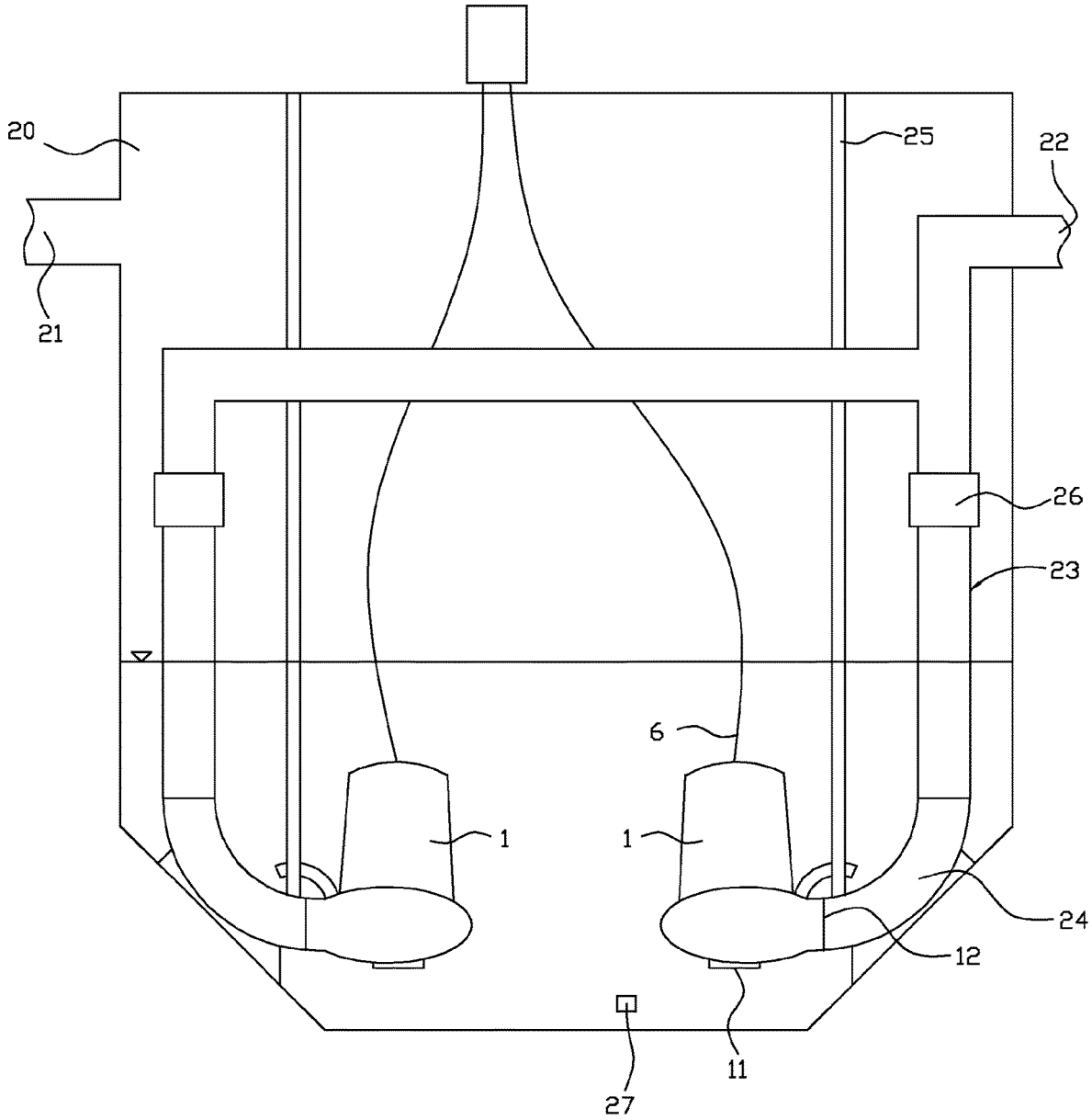
FIG. 2 is a schematic cross sectional side view of a reservoir comprising two pumps.

Reference is now also made to FIG. 2 disclosing a reservoir 20 or tank, such as a pump station, containing a liquid. The reservoir 20 may also be constituted by a natural or man-made cavity in the ground. According to the disclosed embodiment, the reservoir 20 comprises an inlet 21 and an outlet 22. At least one pump 1 is located in the reservoir 20, wherein the outlet 12 of the pump 1 is connected to the outlet 22 via an outlet pipe 23 that comprises a discharge connection 24. In the disclosed embodiment, the pump 1 is configured to be lowered into the reservoir 20 and hoisted from the reservoir 20 along guide bars 25 using a chain/wire. At the operational position in the reservoir, the pump 1 automatically connect/dock with the discharge connection 24 in a conventional way. According to other embodiments the outlet pipe 23 is connected to the pump 1 when the pump 1 is lowered into the reservoir 20. The outlet pipe 23 comprises a non-return valve 26, in order to prevent the pumped liquid to return to the reservoir 20 when the pump 1 is deactivated and/or to prevent the pumped liquid from one pump 1 to flow through another pump directly back into the reservoir 20.

The disclosed reservoir 20 also comprises a level sensor 27 that is primarily configured to determine when to activate and deactivate the pump 1. The level sensor 27 is also configured to be able to determine the location of the liquid surface between the pump start liquid level and the pump stop liquid level. The level sensor 27 is preferably located below the inlet 11 of the pump 1 in order to be always submerged. According to various alternative embodiments the level sensor is constituted by a dry installed level sensor, e.g. using ultrasound, radar, etc., hanging above the liquid level and/or located outside the reservoir 20.

The present invention is based on the presence of a priming condition, which can be automatically set or manually set. A priming condition is for instance that the operator, in connection with service of the pump 1 and/or lowering of the pump 1 into the liquid, initiates a priming of the pump 1 since it is a great risk that air/gas becomes trapped in the volute 10 when the pump 1 is lowered into the liquid. A priming condition is for instance present following a snoring detection/operation of the pump 1, since it is a great risk that air/gas becomes trapped in the volute 10 when the pump 1 has been snoring. A priming condition is for instance that the pump 1 is lowered into an empty reservoir 20 and the liquid level is for the first time above the hydraulic unit 3 of the pump 1, since it is a great risk that air/gas becomes trapped in the volute 10 when the pump 1 is submerged into the liquid. These and other similar priming conditions, are precautionary measures.

Thus, the inventive method is associated with start/restart of the pump 1 and in response to a priming condition a priming of the pump 1 is performed, wherein the priming comprises the steps of:

- confirming that the liquid level in the reservoir 20 is located at the same level or above the upper portion of the impeller 8,
- driving the impeller 8 in a reverse direction of rotation in order to generate a flow of gas/liquid mixture from the volute 10 out through the inlet 11 of the pump 1, wherein the duration of the reverse operation of the impeller 8 is equal to or more than 2 seconds and equal to or less than 5 seconds,
- stopping the impeller 8 from rotating in the reverse direction of rotation,
- driving the impeller 8 in a forward direction of rotation in order to generate a flow of liquid from the volute 10 out through the outlet 12 of the pump 1,
- detecting, during the forward operation of the impeller 8, whether too much gas is present in the volute 10 preventing the impeller 8 from generating the expected flow of liquid from the volute 10 out through the outlet 12 of the pump 1, and
- in response to detection of too much gas in the volute 10, stopping the impeller 8 from rotating in the forward direction of rotation and returning to the step of driving the impeller 8 in the reverse direction of rotation, and in response to non-detection of too much gas in the volute 10, exiting the priming of the pump 1.

When the impeller 8 is stopped after reverse operation, there is an under-pressure situation in the volute 10 due to the ejected amount of fluid-mixture (gas and liquid) and liquid will be sucked into the inlet 11 and replace the ejected liquid and ejected gas, i.e. priming the volute 10 and the pump 1. Each loop of reverse operation will remove a significant amount of gas/air.

The first step of confirming that the liquid level is at the same level or above the upper portion of the impeller 8, is performed to secure that during the priming the liquid may refill the volute 10 to such an extent that the impeller 8 is submerged. If the liquid level in the reservoir 20 is lower, the liquid level in the volute 10 during the priming cannot become high enough. Usually the priming takes place in connection with the liquid level in the reservoir 20 is at the pump start liquid level, which in most applications is a distance above the pump 1.

According to various embodiment the driving the impeller 8 in the forward direction of rotation at a normal operational speed is continued after the exiting of the priming of the pump 1.

According to various embodiments, the step of detecting whether too much gas is present in the volute 10 during the forward operation of the impeller 8, comprises the steps of:

monitoring the correlation between the consumed power of the pump 1 and the operational speed of the pump 1, and in response to a too low level of consumed power in relation to the operational speed of the impeller 8, it is detected that too much gas is present in the volute 10.

The steps of said step of detecting whether too much gas is present in the volute 10 during the forward operation of the impeller 8, may also be used as a priming condition. The same applies when snoring is detected, using any appropriate method to detect snoring, in connection with start/restart of the pump 1.

According to various embodiments, the step of detecting whether too much gas is present in the volute 10 during the forward operation of the impeller 8, comprises the steps of:

monitoring whether the liquid level in the reservoir 20 is raising, and in response to raising liquid level in the reservoir 20 at the same time as the consumed power of the pump 1 is below a predetermined threshold, it is detected that too much gas is present in the volute 10.

The steps of said step of detecting whether too much gas is present in the volute 10 during the forward operation of the impeller 8, may also be used as a priming condition.

According to various embodiments, the operational speed of the pump 1 during the reverse operation of the impeller 8 during the priming is equal to or more than 50% of the max operational speed of the pump 1 and is equal to or less than 100% of the max operational speed of the pump 1. The operational speed during the reverse operation has to be high enough to generate a liquid/gas mixture, i.e. turbulence, and forcing the fluid-mixture out through the inlet 11 of the pump 1.

According to various embodiments, the operational speed of the pump 1 during the forward operation of the impeller 8 during the priming is equal to or more than 50% of the max operational speed of the pump 1 and is equal to or less than 100% of the max operational speed of the pump 1. Using a higher operational speed during the forward operation and during the step of determining whether too much gas is present in the volute 10, provides better chance to grab hold of the liquid at the inlet 11 of the pump 1 and also a more clear determination that the consumed power is below a predetermined threshold associated with the operational speed utilized.

According to various embodiments, the duration of the forward operation of the impeller 8 during the priming is equal to or more than 5 seconds and equal to or less than 30 seconds.

According to various embodiments, before initiating the forward operation of the impeller 8 during the priming it is verified that the impeller 8 is standing still. One way of verifying stand still is that no current/power is used by the electric motor 15, or that the output frequency from the control unit 4 to the electric motor 15 is zero.

According to various embodiments, before initiating the reverse operation of the impeller 8 during the priming it is verified that the impeller 8 is standing still. One way of verifying stand still is that no current/power is used by the electric motor 15, or that the output frequency from the control unit 4 to the electric motor 15 is zero.

Thus, stopping the impeller 8 means that the rotational speed of the impeller 8 is decreased in a controlled manner by the control unit 4 and/or by disengaging the control unit 4 from the electric motor 15, i.e. freewheel.

According to another aspect of the invention it is provided a computer-readable storage medium having computer-readable program code portions embedded therein, wherein the computer-readable program code portions when executed by a computer cause the computer to carry out the steps of the above method in order to perform a priming of the pump 1.

FEASIBLE MODIFICATIONS OF THE INVENTION

The invention is not limited only to the embodiments described above, which primarily have an illustrative and exemplifying purpose. This patent application is intended to cover all adjustments and variants of the preferred embodiments described herein, thus the present invention is defined by the wording of the appended claims and the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicate mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

Throughout this specification and the claims which follows, unless the context requires otherwise, the word "comprise", and variations such as "comprises" or "comprising", will be understood to imply the inclusion of a stated integer or steps or group of integers or steps but not the exclusion of any other integer or step or group of integers or steps.

The invention claimed is:

1. A Method for monitoring and controlling an operation of a submersible pump, the pump being located in a reservoir containing a liquid, wherein the pump comprises an inlet, and outlet, a volute located between said inlet and said outlet, and an impeller located in said volute, the method being characterized by a step of performing a priming of the pump in response to a priming condition, wherein the priming comprises steps of:

confirming that a liquid level in the reservoir is located at a same level or above an upper portion of the impeller, driving the impeller in a reverse direction of rotation in order to generate a flow of gas/liquid mixture from the volute out through the inlet of the pump, wherein a duration of the reverse operation of the impeller is equal to or more than 2 seconds and equal to or less than 5 seconds, stopping the impeller from rotating in the reverse direction of rotation, driving the impeller in a forward direction of rotation in order to generate a flow of liquid from the volute out through the outlet of the pump, detecting, during the forward operation of the impeller, whether too much gas is present in the volute preventing the impeller from generating an expected flow of liquid from the volute out through the outlet of the pump, and in response to detection of too much gas in the volute, stopping the impeller from rotating in the forward direction of rotation and returning to the step of driving the impeller in the reverse direction of rotation, and in response to non-detection of too much gas in the volute, exiting the priming of the pump.

2. The method according to claim 1, wherein the step of detecting whether too much gas is present in the volute during the forward operation of the impeller, comprises steps of:

monitoring a correlation between a consumed power of the pump and an operational speed of the pump, and in response to a too low level of consumed power in relation to an operational speed of the impeller, detecting that too much gas is present in the volute.

3. The method according to claim 1, wherein the step of detecting whether too much gas is present in the volute during forward operation of the impeller, comprises steps of:

monitoring whether the liquid level in the reservoir is raising, and in response to raising liquid level in the reservoir at a time when a consumed power of the pump is below a predetermined threshold, detecting that too much gas is present in the volute.

4. The method according to claim 1, wherein an operational speed of the pump during the reverse operation of the impeller during the priming is equal to or more than 50% of a max operational speed of the pump and is equal to or less than 100% of the max operational speed of the pump.

5. The method according to claim 1, wherein an operational speed of the pump during the forward operation of the impeller during the priming is equal to or more than 50% a max operational speed of the pump and is equal to or less than 100% of the max operational speed of the pump.

6. The method according to claim 1, wherein a duration of the forward operation of the impeller during the priming is equal to or more than 5 seconds and equal to or less than 30 seconds.

7. The method according to claim 1, wherein before initiating the forward operation of the impeller during the priming verifying that the impeller is standing still.

8. The method according to claim 1, wherein before initiating the reverse operation of the impeller during the priming verifying that the impeller is standing still.

9. A computer-readable storage medium having computer-readable program code portions embedded therein, wherein the computer-readable program code portions when executed by a computer cause the computer to carry out the steps of the method for monitoring and controlling the operation of the submersible pump of claim 1 in order to perform a priming of the pump.

* * * * *